United States Patent [19]

Miyahara

[11] Patent Number: 4,828,975

[45] Date of Patent: May 9, 1989

[54] FUEL GASIFYING BURNER

[75] Inventor: Kingo Miyahara, Tokyo, Japan

[73] Assignee: Dowa Co., Ltd., Tokyo, Japan

[21] Appl. No.: 146,542

[22] Filed: Jan. 21, 1988

[51] Int. Cl.[4] ..... F23D 11/04

[52] U.S. Cl. ..... 431/168; 431/210

[58] Field of Search ..... 431/168, 169, 210; 239/214.25

[56] References Cited

U.S. PATENT DOCUMENTS 4,247,282 1/1981 Miyahara ..... 431/168

4,516,931 5/1985 Miyahara ..... 431/168

FOREIGN PATENT DOCUMENTS 59-147918 8/1984 Japan .

*Primary Examiner*—Carroll B. Dority, Jr.

*Attorney, Agent, or Firm*—Pollock, Vande Sande & Priddy

[57] ABSTRACT

A fuel gasifying burner comprising a combustion plate having peripheral and bottom combustion surfaces provided with a plurality of gasified fuel blowing openings. The combustion plate is arranged within a combustion cylinder to define therebetween peripheral and bottom gas chambers communicating with each other. A partition plate is arranged within the bottom gas chamber to divide the same into first and second chamber sections. The first chamber section has an inner peripheral open end communicating with an axial open end of a fuel gasifying member rotatably arranged within the combustion cylinder. The partition plate forms an annular flow branching channel at a location where the peripheral and bottom gas chambers communicate with each other. Gasified fuel-air mixture entering the first chamber section is divided into two mixture streams at the annular flow branching channel. One of the two mixture streams is directed toward the second chamber section, and the other mixture stream is directed toward the peripheral gas chamber.

8 Claims, 2 Drawing Sheets

FUEL GASIFYING BURNER

BACKGROUND OF THE INVENTION

The present invention relates to a fuel gasifying burner having a peripheral combustion surface and a bottom combustion surface arranged in a combustion cylinder, in which gasified fuel-air mixture generated within a fuel gasifying member can be blown from the peripheral and bottom combustion surfaces substantially equally in amount to each other so that the blown mixture is burnt.

A fuel gasifying burner is known from, for example, Japanese Patent Application Laid-Open No. 59-147918, in which gasified fuel-air mixture is generated within a fuel gasifying member rotated within a combustion cylinder. The mixture is simultaneously blown from a peripheral combustion surface extending along a peripheral wall of the combustion cylinder and from a bottom combustion surface at a bottom wall of the combustion cylinder, and the blown mixture is burnt, thereby attempting to improve combustion heating efficiency. The known burner will be described below in more detail with reference to FIG. 2 of the accompanying drawings.

As shown in FIG. 2, the known burner comprises a combustion cylinder 1 having a peripheral wall and a bottom wall provided at axial one end of the peripheral wall. The other axial end of the peripheral wall is open. A combustion plate 2 is arranged within the combustion cylinder 1, and has a peripheral combustion surface 3 and a bottom combustion surface 4 which are provided with a plurality of gasified fuel blowing openings 5. The combustion plate 2 cooperates with the combustion cylinder 1 to define therebetween a peripheral gas chamber 6 and a bottom gas chamber 7 which communicate with each other. A fuel gasifying member 9 is rotatably arranged within the combustion cylinder 1. The fuel gasifying member 9 has at its axial one end a bottom wall, and has the other axial open end which communicates with an inner peripheral open end 8 of the bottom gas chamber 7. Gasified fuel-air mixture generated within the fuel gasifying member 9 is simultaneously blown through the openings 5 in the peripheral combustion surface 3 and through the openings 5 in the bottom combustion surface 4, so that the blown mixture is burnt.

For the above-described known burner having the peripheral and bottom combustion surfaces 3 and 4 arranged within the combustion cylinder 1, it is inevitable that the gasified fuel-air mixture generated within the fuel gasifying member 9 flows strongly into the peripheral gas chamber 6 disposed along the peripheral wall of the combustion cylinder 1, when the gasified fuel-air mixture is simultaneously blown from the peripheral and bottom combustion surfaces 3 and 4 and the blown mixture is burnt. This causes a reduction in amount of the mixture blown from the bottom gas chamber 7. As a result, the mixture blown from the peripheral combustion surface 3 becomes stronger in force or power than the mixture blown from the bottom combustion surface 4. Thus, it is difficult to blow and burn the mixture from the peripheral and bottom combustion surfaces 3 and 4 in an even or equal manner.

SUMMARY OF THE INVENTION

It is an object of the invention to provide a fuel gasifying burner which can blow gasified fuel-air mixture evenly or equally from peripheral and bottom combustion surfaces to burn the blown mixture, thereby enabling gasified fuel combustion flames to be formed stably for a long period of time.

According to the invention, there is provided a fuel gasifying burner comprising:

a combustion cylinder having a peripheral wall and a bottom wall provided at axial one end of the peripheral wall;

a combustion plate having a peripheral combustion surface and a bottom combustion surface which are provided with a plurality of gasified fuel blowing openings, the combustion plate being arranged within the combustion cylinder and cooperating with the same to define therebetween a peripheral gas chamber along the peripheral wall of the combustion cylinder and a bottom gas chamber at the bottom wall of the combustion cylinder, the peripheral and bottom gas chambers communicating with each other, the bottom gas chamber having an inner peripheral open end;

a fuel gasifying member arranged within the combustion cylinder for rotation about an axis thereof, the fuel gasifying member having a peripheral wall extending about the axis of the combustion cylinder, the peripheral wall of the fuel gasifying member having axial one open end and the other axial closed end, the axial one open end communicating with the inner peripheral open end of the bottom gas chamber; and a partition plate arranged within the bottom gas chamber to divide the same into first and second chamber sections arranged along the axis of the combustion cylinder, the first chamber section having an inner peripheral open end serving as the inner peripheral open end of the bottom gas chamber, the partition plate forming an annular flow branching channel at a location where the peripheral and bottom gas chambers communicate with each other, the first and second chamber sections communicating with each other through the annular flow branching channel, wherein gasified fuel-air mixture entering the first chamber section from the fuel gasifying member is divided into two streams at the annular flow branching channel, one of the two mixture streams being directed toward the second chamber section, and the other mixture stream being directed toward the peripheral gas chamber.

DETAILED DESCRIPTION

The invention will be described in detail, by way of mere example, with reference to FIG. 1.

Figure 1:
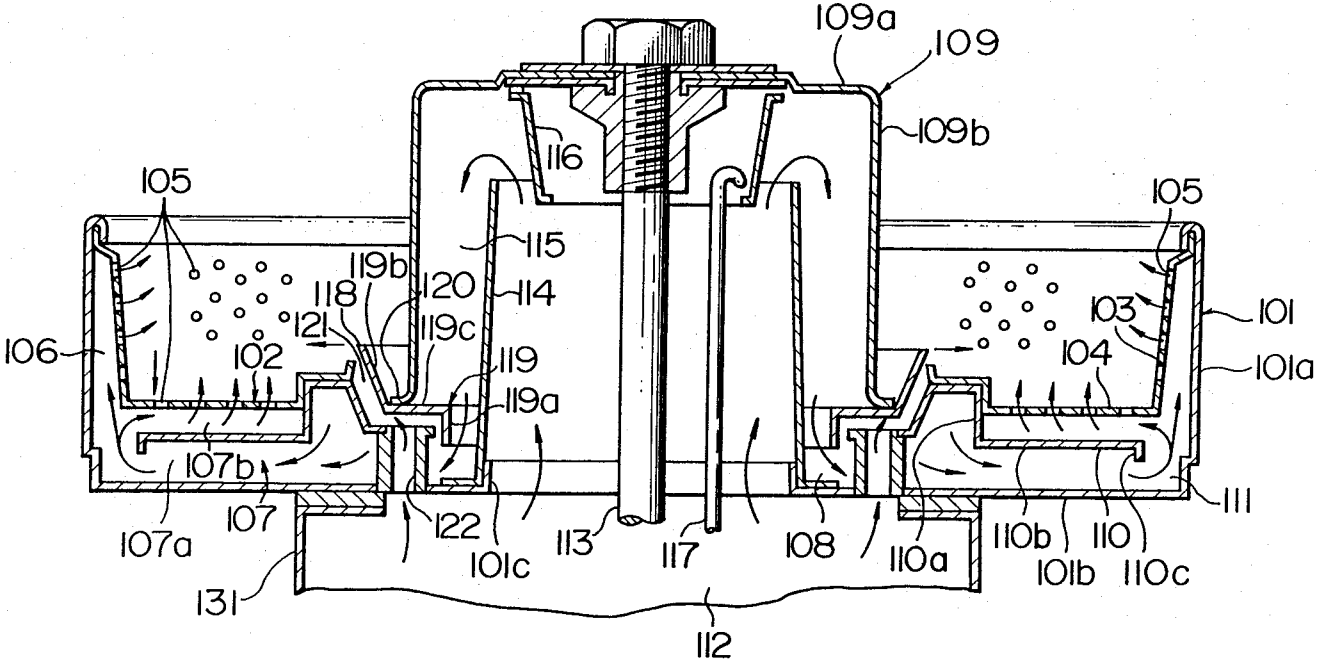
FIG. 1 is a fragmental, longitudinal cross-sectional view of a fuel gasifying burner according to an embodiment of the invention.
Figure 2:
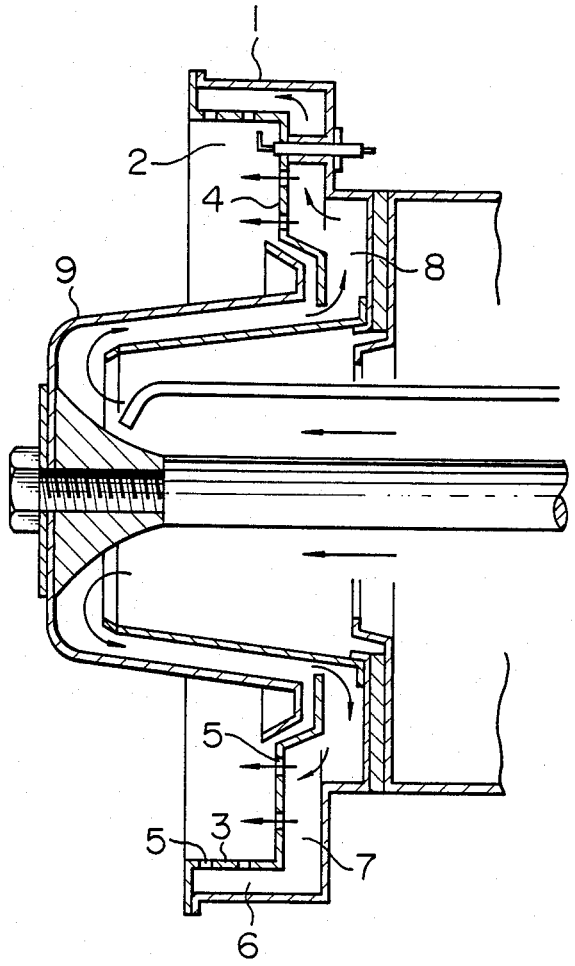
FIG. 2 PRIOR ART
FIG. 2 is a fragmental, longitudinal cross-sectional view of a fuel gasifying burner of the prior art.

A fuel gasifying burner according to an embodiment of the invention comprises, as shown in FIG. 1, a combustion cylinder 101 which has a peripheral wall **101*a* and a bottom wall 101*b* at axial one end of the peripheral wall 101*a*. The peripheral wall 101*a* is open at the other axial end. The bottom wall 101*b* is formed therein with a central opening 101*c*. A cylindrical member 131 is fixedly mounted to an outer end face of the bottom wall 101*b* to define an air blowing chamber 112**.

An annular combustion plate 102 is arranged within the combustion cylinder 101. The combustion plate 102 has a peripheral wall extending about an axis of the combustion cylinder 101, and a bottom wall spaced from the bottom wall 101*b* along the axis of the combustion cylinder 101. The peripheral wall of the combustion plate 102 has a peripheral combustion surface 103 provided with a plurality of gasified fuel blowing openings 105. The bottom wall of the combustion plate 102 has a bottom combustion surface 104 provided with a plurality of gasified fuel blowing openings 105. The combustion plate 102 cooperates with the combustion cylinder 101 to define therebetween a peripheral gas chamber 106 and a bottom gas chamber 107 which communicate with each other. The peripheral gas chamber 106 has its axial closed end remote from the bottom wall 101*b* of the combustion cylinder 101. The bottom gas chamber 107 has an inner peripheral open end 108.

A rotary shaft 113 extends along the axis of the combustion cylinder 101 and through the central opening 101*c* in the bottom wall 101*b* of the combustion cylinder 101. The rotary shaft 113 has its forward end projecting axially outwardly from the other axial open end of the combustion cylinder 101.

A fuel gasifying member 109 is arranged within the combustion cylinder 101, and is mounted on the rotary shaft 113 for rotation therewith. The fuel gasifying member 109 has a bottom wall 109*a* fixedly mounted to the forward end of the rotary shaft 113, and a peripheral wall 109*b* extending from the bottom wall 109*a* toward the bottom wall 101*b* of the combustion cylinder 101. The peripheral wall 109*b* has an open free end which communicates with the inner peripheral open end 108 of the bottom gas chamber 107.

A partition plate 110 is arranged within the bottom gas chamber 107 to divide the same into first and second chamber sections 107*a* and 107*b* which are arranged along the axis of the combustion cylinder 101. The partition plate 110 has a peripheral wall 110*a* extending from the bottom wall of the combustion plate 102 toward the bottom wall 101*b* of the combustion cylinder 101, and an extension wall 110*b* extending radially outwardly from an end of the peripheral wall 110*a* adjacent the bottom wall 101*b*. Thus, the first chamber section 107*a* has its inner peripheral open end serving as the above-mentioned inner peripheral open end 108 of the bottom gas chamber 107. An annular flange 110*c* extends from an outer peripheral end of the extension wall 110*b* toward the bottom wall 101*b* of the combustion cylinder 101. The outer peripheral end of the extension wall 110*b* is spaced radially inwardly from the peripheral wall 101*a* of the combustion cylinder 101 to define therebetween an annular flow branching channel 111 at a location where the peripheral and bottom gas chambers 106 and 107 communicate with each other.

As described above, the bottom gas chamber 107 is divided into the first and second chamber sections 107*a* and 107*b* by the partition plate 110. Thus, as will be described later, gasified fuel-air mixture generated within the fuel gasifying member 109 flows into the first chamber section 107*a* through the inner peripheral open end 108 thereof, and flows along the partition plate 110. Then, the mixture flow can substantially equally be divided into two mixture streams at the annular flow branching channel 111. One of the two mixture streams is directed toward the second chamber section 107*b*, and the other mixture stream is directed toward the peripheral gas chamber 106.

An air supply duct 114 is fixedly mounted to the bottom wall 101*b* of the combustion cylinder 101 and surrounds the central opening 101*c* in the bottom wall 101*b*. The air supply duct 114 extends from the bottom wall 101*b* into the fuel gasifying member 109 to define therebetween a gasified fuel-air mixture passage 115 which has an upstream end in communication with the air blowing chamber 112 through the central opening 101*c*, and a downstream end in communication with the inner peripheral open end 108 of the first chamber section 107*a* of the bottom gas chamber 107.

A fuel diffusing member 116, which has a frustoconical shape converging toward the central opening 101*c* in the bottom wall 101*b*, is fixedly mounted to the bottom wall 109*a* of the fuel gasifying member 109 and extends into the open free end of the air supply duct 114. A fuel supply line 117 extends into the fuel diffusing member 116 through the central opening 101*c* and the air supply duct 114, and has a forward end which is directed toward an inner peripheral surface of the fuel diffusing member 116 in close relation thereto.

An annular gasified fuel-air mixing plate 119 is fixedly mounted to the other axial open end of the peripheral wall 109*b* of the fuel gasifying member 109. The annular mixing plate 119 has a cylindrical wall 119*a*, a frustoconical wall 119*b*, and an annular radial wall 119*c* extending between the walls 119*a* and 119*b*. The frustoconical wall 119*b* has a free end formed into a liquid fuel scattering end 118. The frustoconical wall 119*b* is spaced radially outwardly from the peripheral wall 109*b* of the fuel gasifying member 109 to define therebetween a liquid fuel scattering gap 120.

An annular air ejection passage 121 is defined between the mixing plate 119 and the bottom gas chamber 107. The annular air ejection passage 121 communicates with the air blowing chamber 112 through a plurality of ventilation pipes 122. The ventilation pipes 122 are arranged in circumferentially equidistantly spaced relation about the axis of the combustion cylinder 101. The annular air ejection passage 121 is a rotational gap for the fuel gasifying member 109. The combustion air is permitted to always flow from the air blowing chamber 112 through the ventilation pipes 122 and the air ejection passage 121 to prevent the other axial end portion of the peripheral wall 109*b* of the fuel gasifying member 109 and the combustion plate 102 from being burnt out.

The operation of the fuel gasifying burner constructed as mentioned above will be described below.

As the burner is started, the fuel gasifying member 109 is rotated at high speed by the rotary shaft 113, and combustion air is blown from the air blowing chamber 112 into the air supply duct 114 through the central opening 101*c* in the bottom wall 101*b* of the combustion cylinder 101. The combustion air flows through the passage 115, and enters the first chamber section 107*a* of the bottom gas chamber 107 through the inner peripheral open end 108 thereof. The combustion air flows along the extension wall 110*b* of the partition plate 110 and reaches the annular flow branching channel 111. The combustion air is substantially equally divided into two streams at the annular flow branching channel 111. One of the two streams flows into the second chamber section 107*b* of the bottom gas chamber 107, and the other stream flows into the peripheral gas chamber 106. Subsequently, the combustion air is blown through the openings 105 in the peripheral combustion surface 103 and through the openings 105 in the bottom combustion surface 104 substantially equally in amount to each other.

With the combustion air flowing in the manner as described above, liquid fuel is supplied through the fuel supply line 117. Then, the fuel is diffused and atomized or pulverized by the fuel diffusing member 116 and is further atomized by the blowing action of the combustion air blown from the air blowing chamber 112. The atomized fuel is carried by the combustion air flow described above and is blown through the openings 105 in the peripheral and bottom combustion surfaces 103 and 104. The atomized fuel blown through the openings 105 is ignited and is burnt in a liquid state to generate flames.

By the flames due to the liquid state combustion of the fuel, the entire fuel gasifying member 109 is heated. Thus, after this, the fuel supplied from the fuel supply line 117 into the heated fuel gasifying member 109 is evaporated and gasified thereby. The gasified fuel is agitated and mixed with the combustion air to form gasified fuel-air mixture. The gasified fuel-air mixture flows into the first chamber section 107*a* of the bottom gas chamber 107 through the inner peripheral open end 108 thereof. The mixture flows along the extension wall 110*b* of the partition plate 110, and reaches the annular flow branching channel 111. The mixture flow is substantially equally divided into two mixture streams at the annular flow branching channel 111. One and the other mixture streams flow under uniform pressure respectively into the peripheral gas chamber 106 and the second chamber section 107*b* of the bottom gas chamber 107.

In the manner as described above, the gasified fuel-air mixture generated within the fuel gasifying member 109 enters under pressure the peripheral gas chamber 106 and the second chamber section 107*b* of the bottom gas chamber 107 substantially equally in amount to each other. The mixture is simultaneously blown through the openings 105 in the peripheral combustion surface 103 and through the openings 105 in the bottom combustion surface 104 substantially equally in amount to each other so that the blown mixture is burnt. Thus, the burner is effectively utilized as a heating source.

As described above, the fuel gasifying burner according to the invention comprises the partition plate 110 which is arranged within the bottom gas chamber 107 to divide the same into the first and second chamber sections 107*a* and 107*b* arranged along the axis of the combustion cylinder 101. The first chamber section 107*a* has the inner peripheral open end 108 communicating with the axial open end of the fuel gasifying member 109. The partition plate 110 forms the annular flow branching channel 111 at a location where the peripheral and bottom gas chambers 106 and 107 communicate with each other. The first and second chamber sections 107*a* and 107*b* communicate with each other through the annular flow branching channel 111. Thus, the gasified fuel-air mixture flowing into the first chamber section 107*b* through the inner peripheral open end 108 thereof flows along the partition plate 110, and is substantially equally divided into two mixture streams at the annular flow branching channel 111. One and the other mixture streams flow respectively into the peripheral gas chamber 106 and the second chamber section 107*b* of the bottom gas chamber 107. The mixture is simultaneously blown through the openings 105 in the peripheral combustion surface 103 and through the openings 105 in the bottom combustion surface 104 substantially equally in amount to each other, so that the blown mixture is burnt. Thus, it is possible to blow the gasified fuel-air mixture evenly or equally from the peripheral and bottom combustion surfaces 103 and 104 to burn the blown mixture, thereby enabling gasified fuel combustion flames to be formed stably for a long period of time.

What is claimed is:

1. A fuel gasifying burner comprising:

a combustion cylinder having a peripheral wall and a bottom wall provided at axial one end of said peripheral wall;

a combustion plate having a peripheral combustion surface and a bottom combustion surface which are provided with a plurality of gasified fuel blowing openings, said combustion plate being arranged within said combustion cylinder and cooperating with the same to define therebetween a peripheral gas chamber along said peripheral wall of said combustion cylinder and a bottom gas chamber at said bottom wall of said combustion cylinder, said peripheral and bottom gas chambers communicating with each other, said bottom gas chamber having an inner peripheral open end;

a fuel gasifying member arranged within said combustion cylinder for rotation about an axis thereof, said fuel gasifying member having a peripheral wall extending about the axis of said combustion cylinder, said peripheral wall of said fuel gasifying member having axial one open end and the other axial closed end, said axial one open end communicating with said inner peripheral open end of said bottom gas chamber; and a partition plate arranged within said bottom gas chamber to divide the same into first and second chamber sections arranged along the axis of said combustion cylinder, said first chamber section having an inner peripheral open end serving as said inner peripheral open end of said bottom gas chamber, said partition plate forming an annular flow branching channel at a location where said peripheral and bottom gas chambers communicate with each other, said first and second chamber sections communicating with each other through said annular flow branching channel, wherein gasified fuel-air mixture entering said first chamber section from said fuel gasifying member is divided into two streams at said annular flow branching channel, one of said two mixture streams being directed toward said second chamber section, and the other mixture stream being directed toward said peripheral gas chamber.

2. A fuel gasifying burner as defined in claim 1, wherein said partition plate has a periphral wall extending from said bottom combustion surface of said combustion plate toward said bottom wall of said combustion cylinder, and an extension wall extending radially outwardly from said peripheral wall of said partition plate.

3. A fuel gasifying burner as defined in claim 2, wherein said extension wall of said partition plate has an outer peripheral end which is spaced radially inwardly from said peripheral wall of said combustion cylinder to define said annular flow branching channel.

4. A fuel gasifying burner as defined in claim 3, wherein said partition plate has an annular flange extending from said outer peripheral end of said extension wall toward said bottom wall of said combustion cylinder.

5. A fuel gasifying burner as defined in claim 1, including:

a central opening formed in said bottom wall of said combustion cylinder;

means cooperating with an outer end face of said bottom wall of said combustion cylinder for defining an air blowing chamber communicating with said central opening in said bottom wall of said combustion cylinder;

a gasified fuel-air mixture passage defined by said peripheral wall of said fuel gasifying member, said gasified fuel-air mixture passage having an upstream end communicating with said air blowing chamber through said central opening in said bottom wall of said combustion cylinder, and a downstream end communicating with said inner peripheral open end of said first chamber section of said bottom gas chamber; and means for supplying liquid fuel into combustion air blown from said air blowing chamber toward said gasified fuel-air mixture passage through said central opening in said bottom wall of said combustion cylinder, to form the gasified fuel-air mixture.

6. A fuel gasifying burner as defined in claim 1, including a tubular fuel diffusing member arranged within said fuel gasifying member and about the axis of said combustion cylinder, said means for supplying liquid fuel comprising a fuel supply line extending from said air blowing chamber into said tubular fuel diffusing member through said central opening in said bottom wall of said combustion cylinder.

7. A fuel gasifying burner as defined in claim 6, wherein said fuel supply line has its free end directed toward a wall of said tubular fuel diffusing member.

8. A fuel gasifying burner as defined in claim 6, including an air supply duct arranged about said central opening in said bottom wall of said combustion cylinder and extending from said bottom wall of said combustion cylinder into said fuel gasifying member, said air supply duct cooperating with said fuel gasifying member to define therebetween said gasified fuel-air mixture passage, said tubular fuel diffusing member extending from the other axial closed end of said fuel gasifying member into said air supply duct.

* * * * *